US007780543B2

(12) United States Patent
Flood

(10) Patent No.: US 7,780,543 B2
(45) Date of Patent: Aug. 24, 2010

(54) GOLF SWING TRAINING DEVICE

(75) Inventor: James J. Flood, Solana Beach, CA (US)

(73) Assignee: Rockroller, LLC, Carson City, NV (US)

( * ) Notice: Subject to any disclaimer, the term of this patent is extended or adjusted under 35 U.S.C. 154(b) by 0 days.

(21) Appl. No.: 11/483,411

(22) Filed: Jul. 6, 2006

(65) Prior Publication Data

US 2007/0021228 A1 Jan. 25, 2007

Related U.S. Application Data

(60) Provisional application No. 60/697,193, filed on Jul. 6, 2005.

(51) Int. Cl.
*A63B 69/36* (2006.01)

(52) U.S. Cl. ..... 473/256; 473/437; 273/DIG. 30

(58) Field of Classification Search ..... 473/219, 473/226, 231, 256, 437, 228; 273/DIG. 30
See application file for complete search history.

(56) References Cited

U.S. PATENT DOCUMENTS 4,247,101 A * 1/1981 Gallmeyer ..... 473/63
4,588,191 A * 5/1986 Stewart ..... 473/256
5,460,378 A * 10/1995 Getts ..... 473/251
5,484,156 A * 1/1996 Giguere ..... 473/256
5,980,397 A * 11/1999 Hart et al. ..... 473/437
6,261,253 B1 * 7/2001 Katzin ..... 602/21
6,533,685 B1 * 3/2003 Otten et al. ..... 473/437
6,739,989 B2 * 5/2004 Liberatore ..... 473/457
6,808,502 B2 * 10/2004 Nguyen ..... 602/21
6,991,612 B2 * 1/2006 Scheinberg et al. ..... 602/6
2003/0078531 A1 * 4/2003 Nguyen ..... 602/22
2003/0130070 A1 * 7/2003 Nolan ..... 473/437
2004/0063519 A1 * 4/2004 Liberatore ..... 473/457
2004/0138598 A1 * 7/2004 Kortuem et al. ..... 602/22
2004/0225241 A1 * 11/2004 Scheinberg et al. ..... 602/5
2004/0259666 A1 * 12/2004 Bjugstad et al. ..... 473/437

* cited by examiner

*Primary Examiner*—Nini Legesse
(74) *Attorney, Agent, or Firm*—Blakely Sokoloff Taylor & Zafman LLP

(57) ABSTRACT

Embodiments include a golf swing training device primarily formed from a first material having dimensions suitable for wrapping around a shaft of a golf club and a second material coupled to the first material wherein the second material conforms to the dimensions of the first material and adds sufficient weight to the golf club. The training device is removable coupled to the shaft of the golf club. A method including securing a swing training device around a portion of the shaft of the golf club, the training device comprising a length dimension suitable to distribute a weight of the training device about a substantial portion of the length of the shaft and then swinging the golf club.

5 Claims, 6 Drawing Sheets

GOLF SWING TRAINING DEVICE

CROSS-REFERENCE TO RELATED APPLICATION

This application claims the benefit of the earlier filing date of provisional Application No. 60/697,193, filed Jul. 6, 2005, and incorporated herein by reference.

FIELD

Golf swing training or practice device.

BACKGROUND

An object of the game of golf is to play a specific number of "holes" in the fewest number of "strokes." Each hole is played beginning at an area known as the "tee" and ending with a circular "cup" 108 millimeters (mm) in diameter and sunken into the ground at least 100 mm. The hole is found on a specially prepared surface known as the "green." The area from the tee to the green is known as the "fairway."

A recognized fundamental necessary for successfully playing the game of golf is the ability of a golfer to properly swing a golf club. The golf club consists of a "head" on one end and a "grip" on the other. The head and grip are connected by a shaft with a grip disposed over a portion of the shaft. The golfer positions his or her hands on the grip and aligns him or herself over a golf ball placed at the golfer's feet. The golfer swings by taking his or her arms backwards (a back swing) and then coming forward to strike the ball.

In order to reduce the number of strokes it takes a golfer to reach the "green" many techniques have been developed and implemented as well as a multitude of design variations in the size and shape of the golf club. It is, however, widely recognized that one of the keys to a successful game of golf is a consistent swing or stroke. Many golfers, in an effort to develop the proper golf swing, experience difficulty maintaining a proper swing tempo. A back swing which is too fast, for example, can cause the golfer to hit the ball differently with each stroke. Learning how to maintain a consistent swing tempo or rhythm with each stroke may result in an improvement in the golfer's game.

SUMMARY

In one embodiment, a golf swing training device is disclosed. The training device attaches to a standard golf club and evenly distributes a weight along a portion of the golf club shaft (e.g., a portion of the shaft between the grip and the head). In this manner, the training device tends to stabilize the tempo of the golfer's swing and inhibits unwanted and undesirable changes in the rhythm of the swing. Representatively, a training device includes a first material suitable for wrapping around a portion of the shaft of a golf club and a second material coupled to the first material, the second material conforming to the dimensions of the first material and adding weight to the training device. The training device is removable such that it may be wrapped and unwrapped around the desired portion of the shaft and different clubs.

When properly secured to the shaft, the swing training device encourages a consistent swing tempo regardless of the particular physical attributes of the golfer. Continued use of the training device in practice develops in the golfer a "muscle memory" that can enhance the ability of the golfer to repeat an optimal golf stroke for success in the game of golf.

Additional features, embodiments, and benefits will be evident in view of the figures and detailed description presented herein.

BRIEF DESCRIPTION OF THE DRAWINGS

Features, aspects, and advantages of embodiments will become more thoroughly apparent from the following detailed description, appended claims, and accompanying drawings in which:

DETAILED DESCRIPTION

Figure 1:
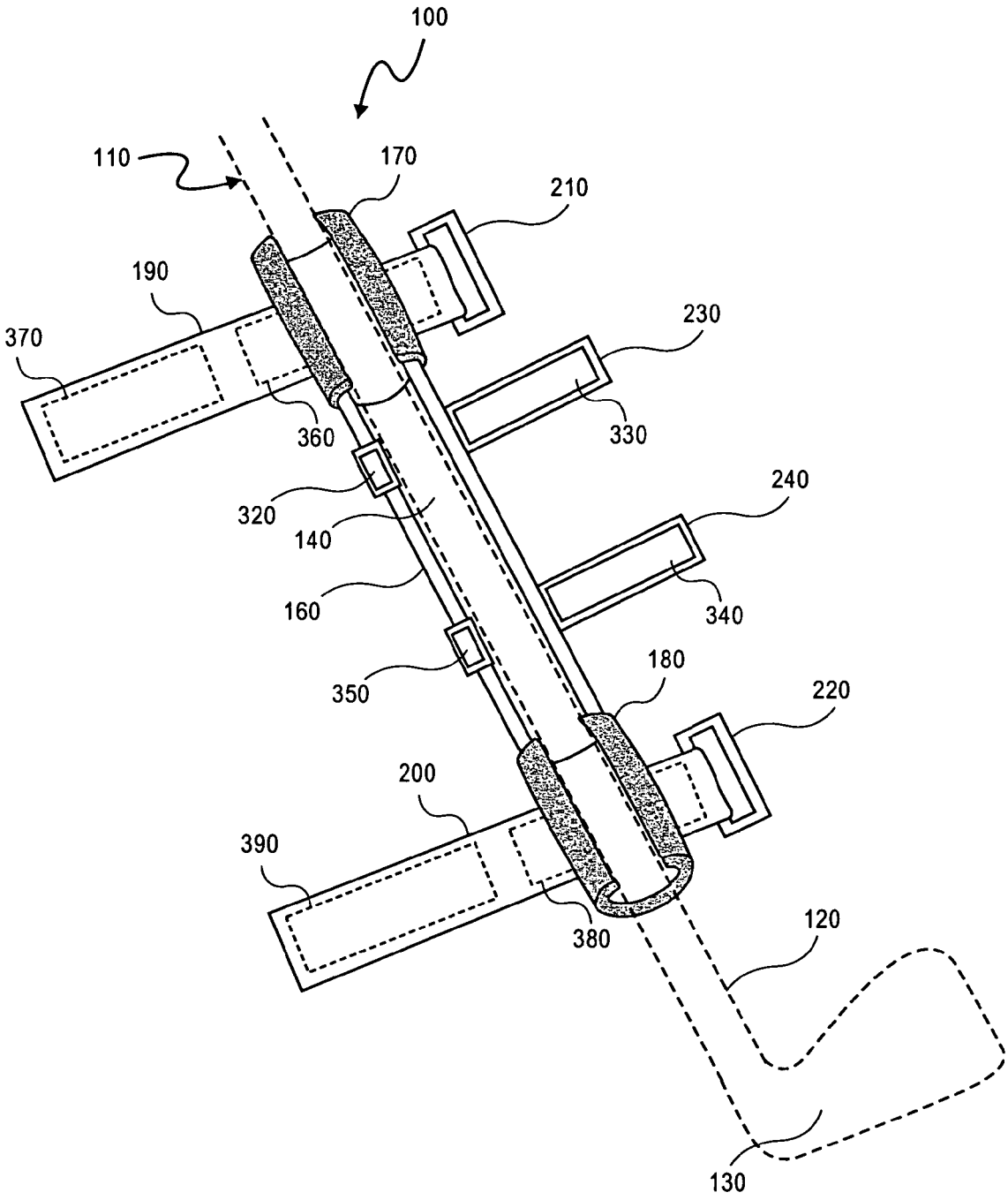
FIG. 1 shows a front perspective view of an embodiment of a golf swing training device.

FIG. 1 illustrates a front perspective view of an embodiment of a golf swing training device. Training device 100 has dimensions suitable for wrapping around shaft 120 of golf club 110 (shown in ghost lines). FIG. 1 shows training device 100 positioned at one end near head 130 of the golf club 110. The training device 100 may be positioned anywhere along shaft 120 between the grip 400 and head 130. In one embodiment, training device 100 has a length less than that of the shaft 120. In another embodiment, the length of training device 100 is greater than half the length of shaft 120. In another embodiment, the length of the training device 100 is such that when it is attached to shaft 120 of golf club 110, a portion of shaft 120 is still visible. The training device 100 may be of any length sufficient to evenly distribute a weight along the length of golf club 110 such that when a golfer swings golf club 110 with training device 100 attached, the device affects a tempo of the swing of the golfer. A representative length is on the order of four to 20 inches.

In one embodiment, training device 100 includes core 140. Core 140 may be substantially "u" shaped to conform to the circumference of shaft 120. Alternatively, core 140 may be of any shape that conforms or can conform to a circumference of shaft 120. In one embodiment, core 140 has a length greater than its width. Representatively, core 140 is of a length so that when training device 100 is positioned on shaft 120, core 140 extends along a substantial portion of a length of shaft 120 between grip 400 and head 130. The width of core 140 may be such that when the device is attached to shaft 120, core 140 covers only a portion of shaft 120 circumference. A suitable material for core 140 is, for example, bisected compressor hose (e.g., one-half inch hose).

Figure 4:
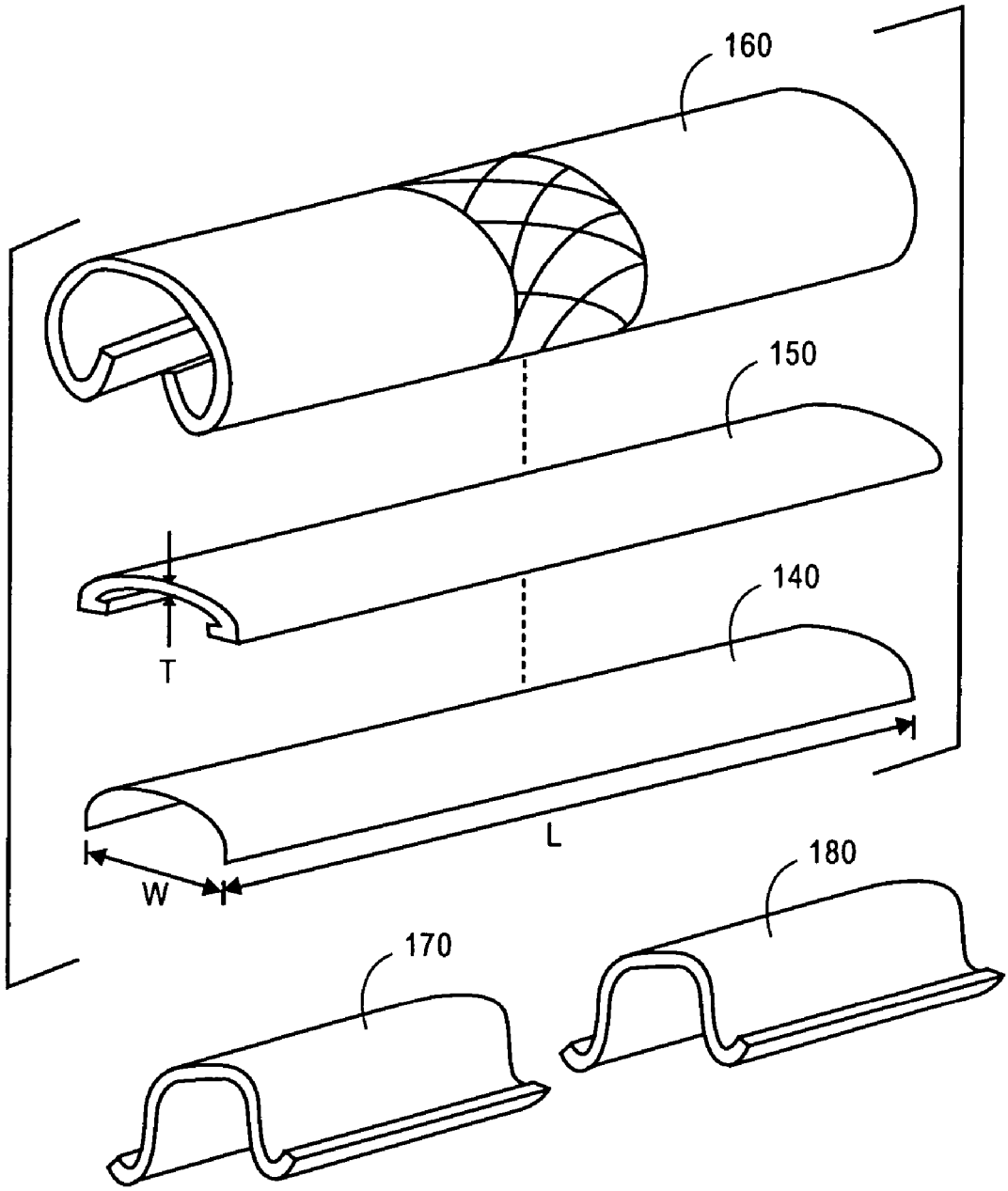
FIG. 4 shows an exploded side perspective view of the training device of FIG. 1.

In one embodiment, training device 100 also includes a second material. Referring to FIG. 4, the second material forms strip 150 for adding weight to the device. Strip 150 may be shaped to substantially conform to an outer dimension of core 140. In an alternative embodiment, strip 150 may be shaped to substantially conform to an inner dimension of the core 140. In one embodiment, strip 150 has a length greater than its width. In one embodiment, strip 150 may have a width less than or equal to a width of core 140. Strip 150 may also have a length less than or equal to a length of core 140. In one embodiment, strip 150 may have a length at least an inch shorter than core 140. In one embodiment, strip 150 may be of any size or shape capable of providing a sufficient weight along shaft 120 of golf club 110 such that when strip 150 is connected to core 140 and training device 100 is used on golf club 110, the device affects a tempo of the golfer's swing. In one embodiment, a suitable weight of strip 150 may be on the order of 20 ounces or less. Suitable materials for strip 150 include, but are not limited to, malleable materials such as a lead strip having a thickness of about 1/16 inch to 1/32 inch. Suitable lead strips are commercially available in sheet form from Industrial Metal Supply Co. of San Diego, Calif. Strips of appropriate dimensions may be cut from a lead sheet.

Strip 150 may be connected to either an inner surface or an outer surface of core 140. Strip 150 may be positioned along core 140 such that a perimeter of strip 150 does not extend outside of a perimeter of core 140. Strip 150 may be attached to core 140 by glue, tape, cement or any similar adhesive. Strip 150 may be positioned along core 140 such that when the device is attached to shaft 120, strip 150 extends along a substantial portion of a length of shaft 120. When training device 100, including strip 150 and core 140, is attached to shaft 120, the weight of the device is evenly distributed along the shaft 120 of the golf club 110. When the golfer practices swinging the golf club 110 with this added weight, the tempo of the golfer's swing is effected. Repeated practice tends to make the swing more consistent throughout the stroke.

In one embodiment, training device 100 includes cover 160. Cover 160 may be formed from a portion of the third material. Cover 160 may be of a sufficient size and shape to overlay a substantial portion of core 140. In one embodiment, cover 160 may be attached to core 140. Cover 160 may be attached to portions of core 140 and strip 150 such that it holds core 140 and strip 150 together. Cover 160 may be attached to core 140 by an adhesive, sewing, stitching or similarly attaching the two together. Cover 160 may be of any flexible material capable of withstanding environmental elements, such as a canvas, vinyl or any other similar woven fabric material. In one embodiment, cover 160 may be of a material known by the trade name Cordura.

In another embodiment, one or more bumpers may be connected to the device. In one embodiment, proximal bumper 170 may be connected to a proximal end of the device and distal bumper 180 may be connected to a distal end of the device. The dimensions of a bumper may conform to the inner dimensions of core 140 so that it may be positioned along the inner surface of core 140. A bumper may be of a size and shape such that when it is positioned within core 140 it covers the entire inner surface of the core 140 but only extends along a portion of an outer surface of core 140. When the training device 100 is attached to shaft 120, bumper 170 and bumper 180 are sandwiched between the core 140 and the shaft 120 so as to allow the device to snuggly fit onto shaft 120 and protect shaft 120 from being scratched by training device 100. Each of bumper 170 and bumper 180 may have a length of less than half the length of the core 140. In an alternative embodiment, each bumper may be of any length sufficient to protect shaft 120 when the device is attached to shaft 120. Each bumper may be of a smooth material capable of conforming to the shape of the core 140 and protecting shaft 120. Suitable materials for bumper 170 and bumper 180 include, but are not limited to, synthetic rubber, plastic, vinyl or similar material. Each of bumper 170 and bumper 180 may be attached to a portion of cover 160 and a portion of core 140. In an alternative embodiment, the bumpers may be attached to one of cover 160 and core 140. In an embodiment where a bumper is attached to core 140, the bumper may hold strip 150 and cover 160 together. The bumper may be attached to cover 160 and a portion of core 140 by an adhesive, sewing, stitching or similar attaching mechanism.

In one embodiment, training device 100 further includes a strap for securing training device 100 to shaft 120 of golf club 110. In another embodiment, training device 100 may include a set of straps. The set of straps may include two pairs of straps, each of the pairs having different dimensions. Each strap may have a length greater than its width. The straps may be of a sufficient length to allow the straps to extend around a circumference of training device 100 when the device is attached to shaft 120. The straps may be positioned at equal distances along the length of cover 160. Representatively, proximal strap 190 may be attached to a proximal end of cover 160. Distal strap 200 may further be attached to a distal end of cover 160. In another embodiment, proximal strap 190 and distal strap 200 may be attached to a bumper attached to the cover 160. A reinforcement strap may further be attached to cover 160 at a position intermediate to proximal strap 190 and distal strap 200. Additional reinforcement straps 230, 240 may be attached to cover 160 at positions between proximal strap 190 and distal strap 200 depending upon the desired level of security.

Proximal strap 190 and distal strap 200 may be of substantially the same size and shape. The intermediate straps may be of substantially the same size and shape. The straps may be of any material capable of wrapping around the training device 100, such as a woven fabric, metal, or vinyl material. The straps may be attached to cover 160 and bumpers by an adhesive, sewing, stitching or similarly attachment mechanism. One end of a strap may be connected to cover 160 such that a free end of the strap may wrap around the circumference of the training device 100 and overlap the one end. Any complimentary securing mechanism, such as a hook and loop type fastener 320, 330 and 340, 350 may be attached along each of the straps so that when the overlapping ends meet, they attach to one another. In another embodiment, buckle 210, 220 or similar fastening device may be attached to one end of the strap so that the free end of the strap wraps around training device 100 and is then looped through buckle 210, 220 or similar fastening device. In this embodiment, after the free end of the strap is looped through the buckle 210, 220, it may be folded back on top of itself. Any complimentary securing mechanism, such as a hook and loop type fastener, 360, 370 and 380, 390 may be attached along the sides of the strap that are adjacent to one another when folded in the manner described above such that when the looped strap portions are pressed together they are secured to one another by the fasteners.

Figure 2:
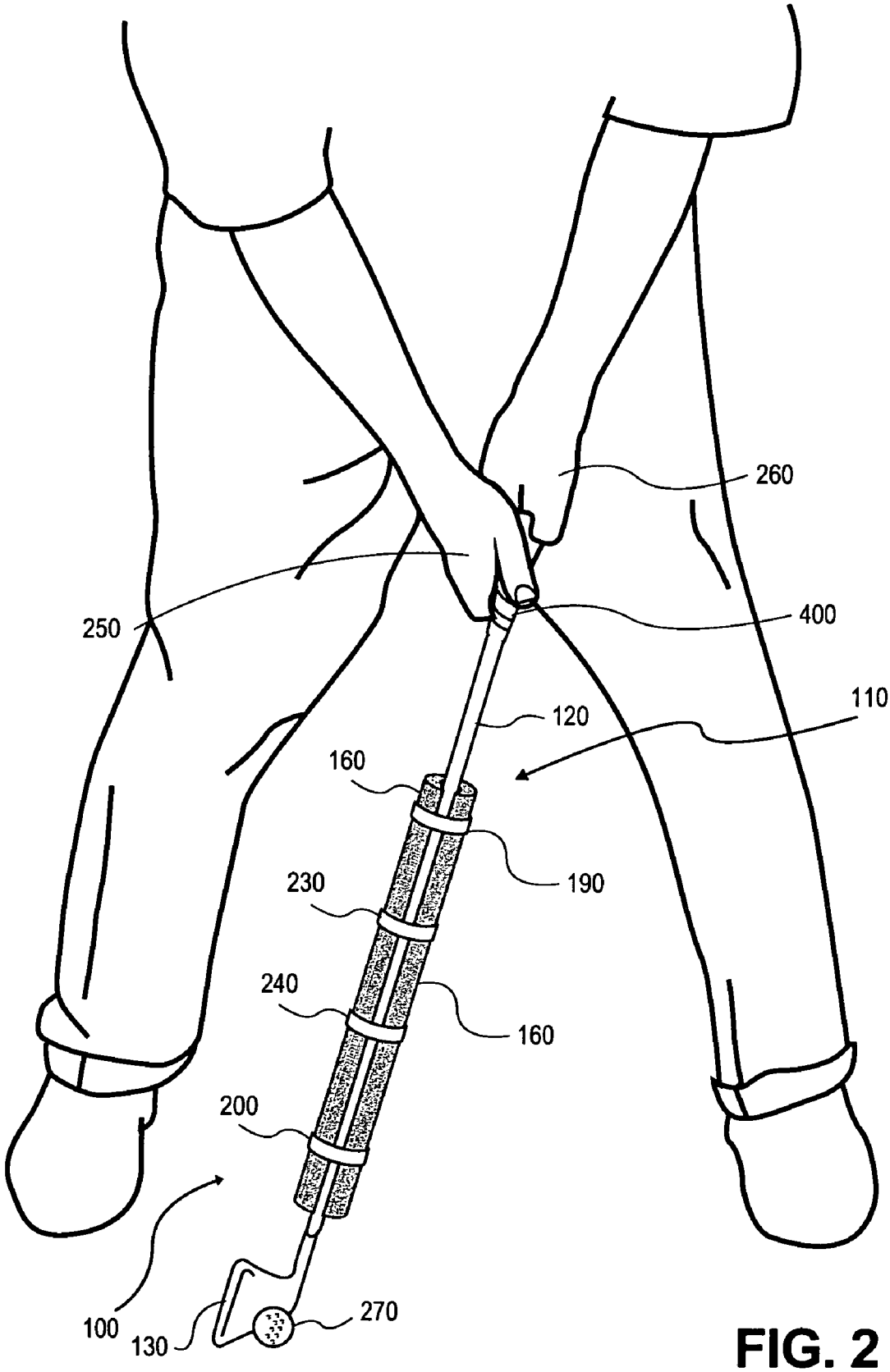
FIG. 2 shows a front side view of a golfer addressing a golf ball and golf training device of FIG. 1.

FIG. 2 shows a front side view of the training device 100 of FIG. 1. FIG. 2 shows a golfer assuming a typical golf stance. In this stance, a golfer positions his/her right hand 250 below his/her left hand 260. Training device 100 is positioned around shaft 120 of the club. An open portion of training device 100 is shown facing away from the golfer to facilitate attachment and removal of the training device 100 from the shaft 120. Representatively, training device 100 is positioned closer to the head 130 of the club than a grip 400 found at the opposite end of the shaft 120. FIG. 2 shows the golfer addressing ball 270 such that head 130 of golf club 110 is positioned behind golf ball 270.

Figure 3:
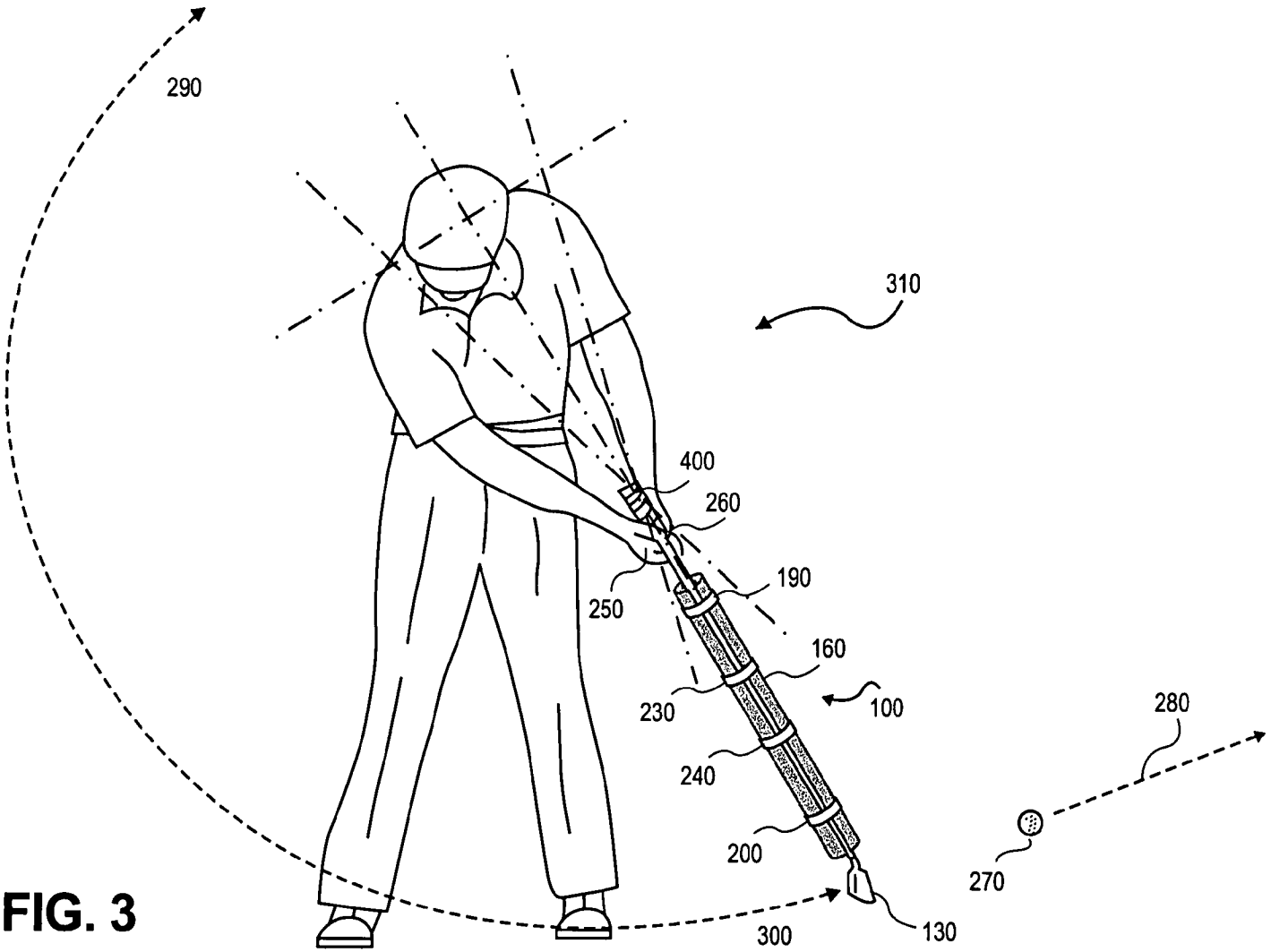
FIG. 3 shows a front side view of a golfer after the golfer addresses the ball.

FIG. 3 is a front view of a golfer after the golfer strikes the ball. FIG. 3 illustrates training device 100 assisting golfer to maintain a consistent tempo throughout the swing. Maintaining a consistent swing tempo between the back swing 290 and the front swing 300 prior to striking the ball tends to improve the likelihood of striking ball consistently and accurately (e.g., to make ball proceed in its intended path 280). Training device 100 assists in making the tempo of the swing consistent throughout the stroke 310. As illustrated in FIG. 3, using the training device 100, the golfer strikes ball 270 sending it along intended path 280.

One use of training device 100 is as part of a regimen to improve a golf swing. The regimen involves, for example, a warm up where a golfer user swings a driver with attached training device, such as device 100, approximately 10 times without hitting a golf ball. Next, the golfer may hit approximately 10 golf balls at half the user's normal swing speed. The user may then hit another 10 golf balls at full swing speed. Upon completion of approximately 30 swings of the driver with attached training device 100, the golfer may engage in a normal practice routine such as hitting golf balls with each club in the bag starting with a wedge.

FIG. 4 shows one method of forming of training device 100. In one embodiment, the first material may be any conventional hose. In a preferred embodiment, the first material is a one-half inch commercially available air compressor hose. Core 140 is formed by bisecting a length of the hose into two halves. The bisected hose is cut into sections having a length of less than that of shaft 120 of the club (less than the length of shaft 120 between grip 400 and head 130. In one embodiment, the first material has a length, L, on the order of approximately 14 inches or less. In another embodiment, the first material has a width, W, on the order of on-half inch.

The second material forming the strip 150 is further illustrated in FIG. 4. In one embodiment, strip 150 may be any malleable material that adds weight to training device 100. In still another embodiment, strip 150 may be a lead, metal or other similar malleable material capable of providing sufficient weight to training device 100. A sufficient weight may include any weight which when added to the shaft 120 of the golf club 110 affects the tempo of the golfer's swing. In one embodiment, the second material has a thickness, T, on the order of about 1/16 inch to about 1/32 inch. In one embodiment, the thickness of the second material T may be 1/16 inch or less.

Figure 5:
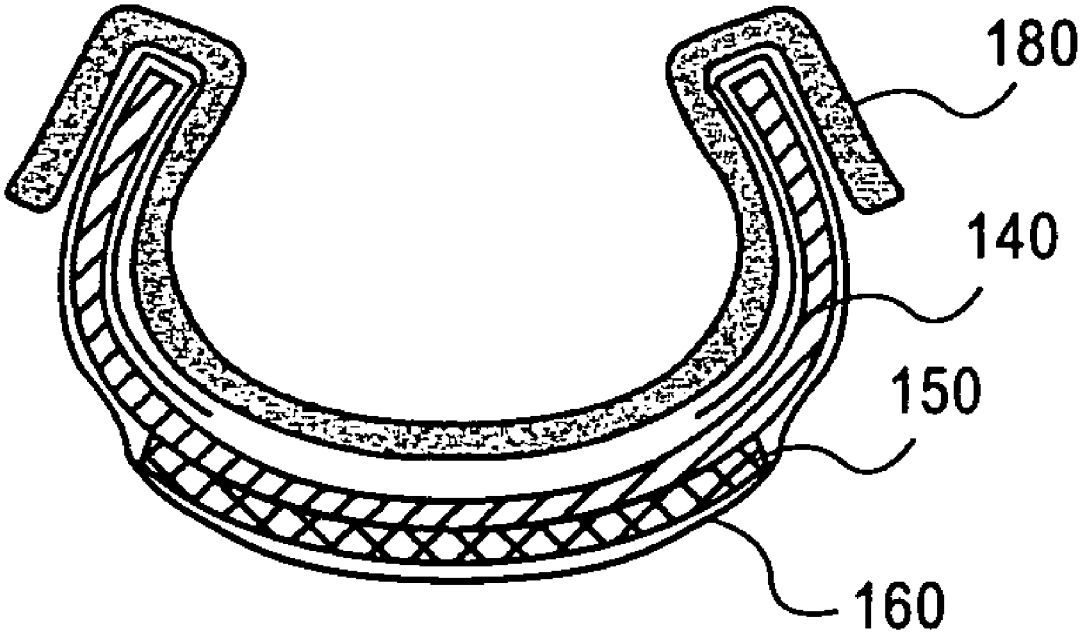
FIG. 5 shows a cross section of one end of the training device of FIG. 1.

As is shown in FIGS. 4 and 5, strip 150 is layered along the outer surface of the first material so as to provide weight along the entire length of core 140. Once strip 150 is placed on an outer surface of core 140, the third material forms a cover 160 over both the first and second materials. As shown in FIG. 4, a portion of the third material having a width greater than that of core 140 is used to form cover 160. In one embodiment, cover 160 is layered over one side of both strip 150 and core 140 leaving a portion of the cover 160 extending beyond the width of core 140. The portion of cover 160 extending beyond the width of core 140 is folded over the edges of core 140 and secured to the inner side of core 140 by glue or stitching. Once core 140, strip 150 and cover 160 are assembled together, the bumpers may be inserted onto portions of the assembly as shown in FIGS. 4 and 5 (e.g., at proximal and distal ends). Bumper 170 and bumper 180 may be secured by adhesive or stitching.

Figure 6:
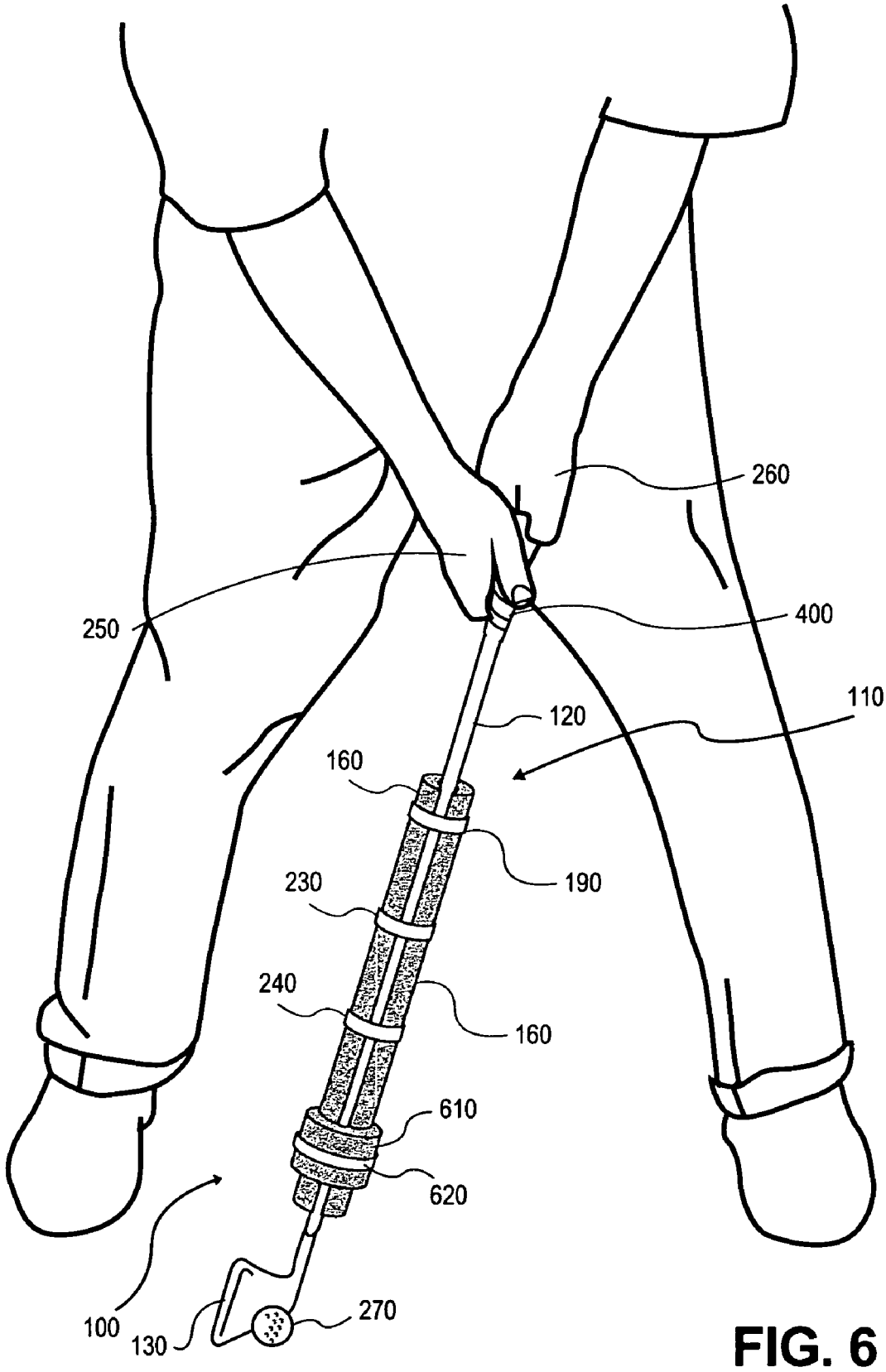
FIG. 6 shows a front side view of a golfer addressing a golf ball and an embodiment of the golf training device of FIG. 1.

As noted in the above embodiment, a training device 100 is formed having a representative length on the order of 14 to 20 inches and a representative weight on the order of nine ounces ("heavy weight"). In another embodiment, a smaller and/or lighter training device is also contemplated. For example, a training device formed as described above with reference to FIGS. 4 and 5 may have a length on the order of seven inches and weigh approximately 4.5 ounces ("middle weight"). Such device may include fewer straps than its longer counterpart. In another embodiment, an even shorter and/or lighter weight training device may be used, such as a device formed as described above with reference to FIGS. 4 and 5, that is four inches and weighs three ounces ("light weight"). This light weight device may be used alone or as an adjunct ("piggy back") device with, for example, the middle weight or heavy weight devices described above. FIG. 6 shows an example of a golfer addressing a golf ball 270 with a golf club 110 having training device 100 fastened to the golf club. Overlying training device 100 at a distal end (closer to the club face) is training device 610. Training device 610 is a smaller version of training device 100. In an embodiment where training device 100 is 14 inches and weighs approximately nine ounces, training device 610 is, for example, a four inch similarly made device, weighing three ounces, bringing the total weight added to the golf club shaft 120 to 12 ounces. It is appreciated that various combinations of heavy weight, middle weight and light weight devices may be used on a golf club to vary the weight added to the club.

In the preceding detailed description, reference is made to specific embodiments thereof. It will, however, be evident that various modifications and changes may be made thereto without departing from the broader spirit and scope of the following claims. The specification and drawings are, accordingly, to be regarded in an illustrative rather than a restrictive sense.

What is claimed is:

1. A golf swing training apparatus comprising:

a U-shaped body comprising:

a cover;

a first material different from the cover and having a U-shape and dimensions suitable for wrapping around a shaft of a golf club and including a length dimension of 14 to 20 inches, and greater than a width dimension;

a second material in the form of a malleable strip coupled to the first material, the second material conforming to the dimensions of the first material and adding a sufficient weight to the golf club, wherein the apparatus is configured to be removable from the shaft and, once removed, the first material retains the U-shape; and wherein the second material is disposed between the cover and the first material.

2. The apparatus of claim 1, wherein the second material comprises lead.

3. The apparatus of claim 1, further comprising:

a third material different from the first material or cover, wherein the first material is disposed between the second material and the third material, the third material comprising a material that is suitable to inhibit scratching of the shaft by the second material.

4. A golf swing training apparatus comprising:

a U-shaped body comprising:

a cover;

a first material different from the cover having a U-shape and dimensions suitable for wrapping around a shaft of a golf club and including a length dimension of 14 to 20 inches, and greater than a width dimension;

a second material comprising lead in the form of a malleable strip coupled to the first material, the second material conforming to the dimensions of the first material and when attached to a shaft of a golf club, adding a sufficient weight to the golf club; and wherein the apparatus is configured to be removable from a shaft of a golf club and, once removed, the first material retains the U-shape.

5. The apparatus of claim 4, further comprising:

a third material different from the first material or cover, wherein the first material is disposed between the second material and the third material, the third material comprising a material that is suitable to inhibit scratching of the shaft by the second material.

* * * * *